United States Patent [19]

Auxier

[11] Patent Number: 4,902,020

[45] Date of Patent: Feb. 20, 1990

[54] INVESTMENT FRANCHISEMENT GAME AND METHOD OF ADVERTISEMENT

[76] Inventor: David Auxier, 3405 Hewitt Ave., Silver Spring, Md. 20906

[21] Appl. No.: 227,868

[22] Filed: Aug. 2, 1988

[51] Int. Cl.[4] ..... A63F 3/00

[52] U.S. Cl. ..... 273/256; 273/284

[58] Field of Search ..... 273/256, 278, 283, 284

[56] References Cited

U.S. PATENT DOCUMENTS

| | | | |
|---|---|---|---|
| 3,698,718 | 10/1972 | Kuhn | 273/256 |
| 4,140,319 | 2/1979 | Aycock et al. | 273/288 |
| 4,378,941 | 4/1983 | Derby | 273/244 |
| 4,426,084 | 1/1984 | Michel | 273/256 |
| 4,561,658 | 12/1985 | Peterson | 273/243 |
| 4,585,232 | 4/1986 | Sheppard et al. | 273/256 |

OTHER PUBLICATIONS

Fairfax Journal, "Their Game a Winner", by Bill Cormier, Jun. 6, 1983, pp. A1, A6.

*Primary Examiner*—Edward M. Cover
*Assistant Examiner*—Benjamin Layno
*Attorney, Agent, or Firm*—Harold Gell

[57] ABSTRACT

A board game and method of playing and designing the game which emulates business property manipulation and retail sales wherein the business properties involved are tailored to fit a specific area of interest or region through the expedient of using preselected groups of playing cards representing business properties such as franchises and the method of tailoring the game to contemporary life by selling to businesses, the advertising advantage of being represented in the game as a business which is one of the integral elements in the play of the game.

27 Claims, 3 Drawing Sheets

ONE
HOUR
PHOTO
ENTIRE STREET DEVELOPED
FEE $50,000
FEE $15,000

$55,000
Single
space
FRANCHISE

THE CLOSET FACTORY
ENTIRE STREET DEVELOPED
FEE $50,000
FEE $25,000

FRANCHISE
$86,000

EXPLORE
VIRGINIA
VISIT
THE
NATURAL
BRIDGE
COST $3,000

VACATION $85,000

LOTTERY

WENT PARACHUTING
FORGOT PARACHUTE!
NEEDED A FEW X-RAY'S
STAY IN FOR 2 TURN'S
PAY $30,000

HOSPITAL

INVESTMENT FRANCHISEMENT GAME AND METHOD OF ADVERTISEMENT

FIELD OF THE INVENTION

The present invention relates to the integration of a board game and advertising method.

BACKGROUND OF THE INVENTION

Since time immemorial, man has played a variety of board games. One of the most popular being the contemporary game of Monopoly. The appeal of the game is that it reflects a basic requirement for survival in a modern world governed by a monitory based economic system. In the game, players compete on a financial basis with gains and losses related to the acquisition and improvement of property.

As successful as Monopoly and similar games are, they have shortcomings in that the players are constrained to predetermined patterns of action and the quest for reality which the games designers had hoped to achieve is never reached. The games stop at property acquisition and thereby fail to consider one of the most moving forces in modern society-commerce. They do not provide the challenging stimulus afforded in the real world when one considers franchise manipulation of everyday, contemporary commercial establishments combined with real property acquisition. Furthermore, the games are fixed with respect to a relatively small group of hypothetical properties and fail to provide a dynamic system wherein a game may be tailored for regional considerations and the current businesses in vogue.

OBJECTIVES OF THE INVENTION

In view of the shortcomings of existing board games, it is a primary objective of the present invention to provide a game which incorporates the principles of real property negotiations with the management of contemporary franchises.

Another objective of the invention is to provide a board game including concepts of business property manipulations wherein the business properties are contemporary and may be regionally adapted.

Another objective of the present invention is to provide a board game for the emulation of business property manipulation wherein the various business properties involved may be tailored to fit a specific area of interest or region through the simple expedient of using preselectable groups of playing cards representing business properties such as franchises.

Another objective of the invention is to provide a board game which is adaptable to contemporary business properties wherein the contemporary nature of the game is assured by using business property cards or representations which are purchased as a form of advertisement by real businesses.

Another objective of the present invention is to provide an adaptable board game wherein various business properties involved in playing of the game represent real life establishments which are incorporated into the game as an advertising means for the real life establishments.

A still further objective of the present invention is to provide a board game for the financial manipulation of franchised businesses, the contemporaneous nature of which is insured by virtue of the fact that the business property representations are actually purchased advertisements of the real world businesses.

A still further objective of the present invention is to create a board game by establishing a predetermined game board layout and selling advertising space on the game board or playing checks to businesses who then become part of the game playing fantasy.

Another objective of the invention is to provide a method for creating a dynamic contemporary game by selling advertising space on game paraphernalia whereby the advertised business become active elements of the game.

SUMMARY OF THE INVENTION

The present invention comprises a game board having a plurality of playing spaces through which a player advances as a function of the casting of a die or similar numerical random chance number generating means. The game board spaces are emulations of properties having various values and may be purchased by players as the game progresses. When a player "owns" an emulated property, and other various game requirements are met, he may buy franchises or similar business properties represented by cards identified by advertisements of actual contemporary business establishments. The advertisements are purchased by business establishments as an integral part of the method of creating the game. The business property playing cards purchased by players are installed on the property spaces owned by the player and fees for merchandise, services etc. are extracted from other players to offset the franchisee or business property purchaser's initial cost and eventually provide a profit. Winning the game is a function of who accumulates the most wealth.

DETAILED DESCRIPTION OF THE INVENTION

Figure 1:
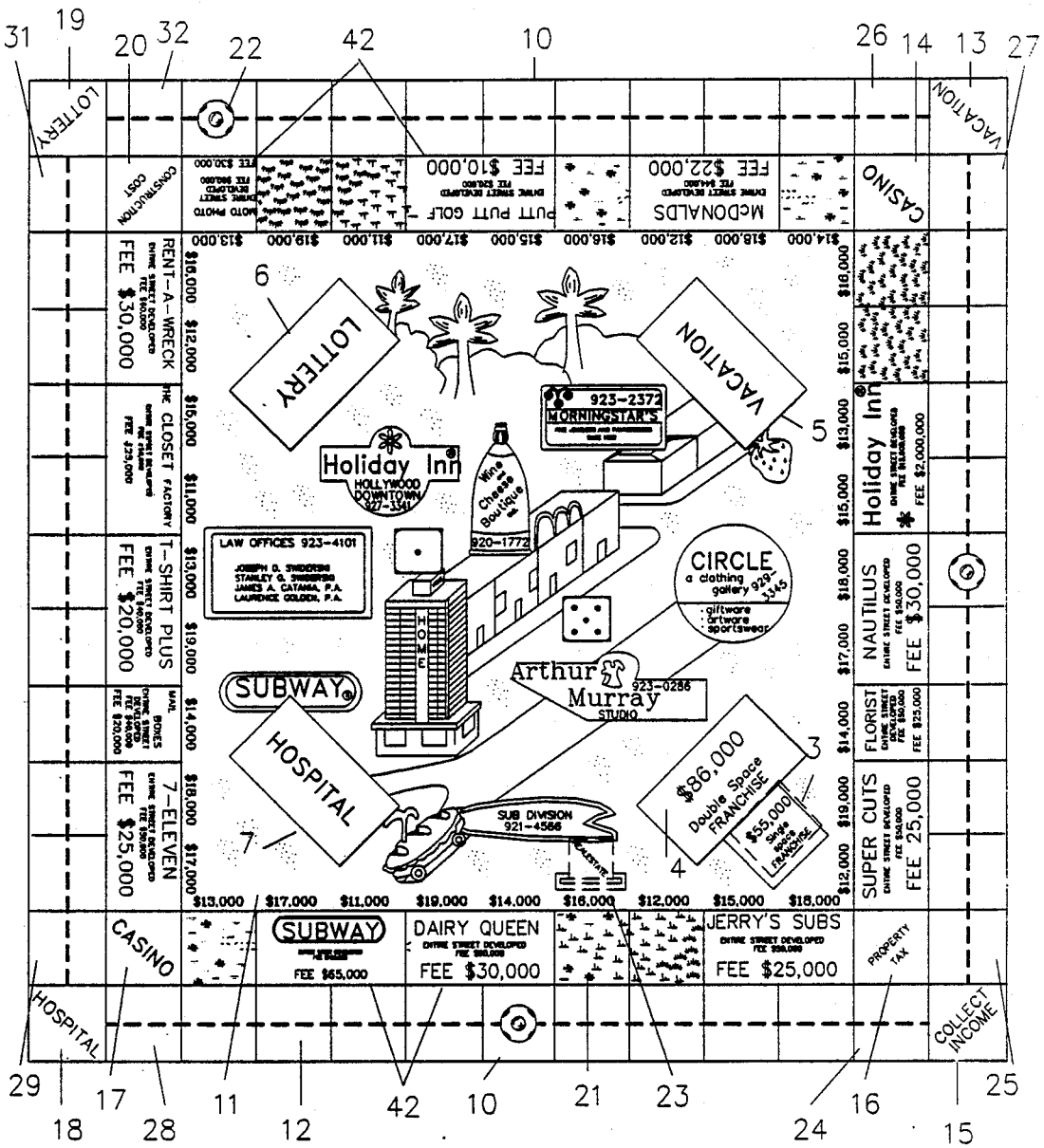
FIG. 1 is an example of the board game as it is played, illustrating a partially completed game.
Figure 2:
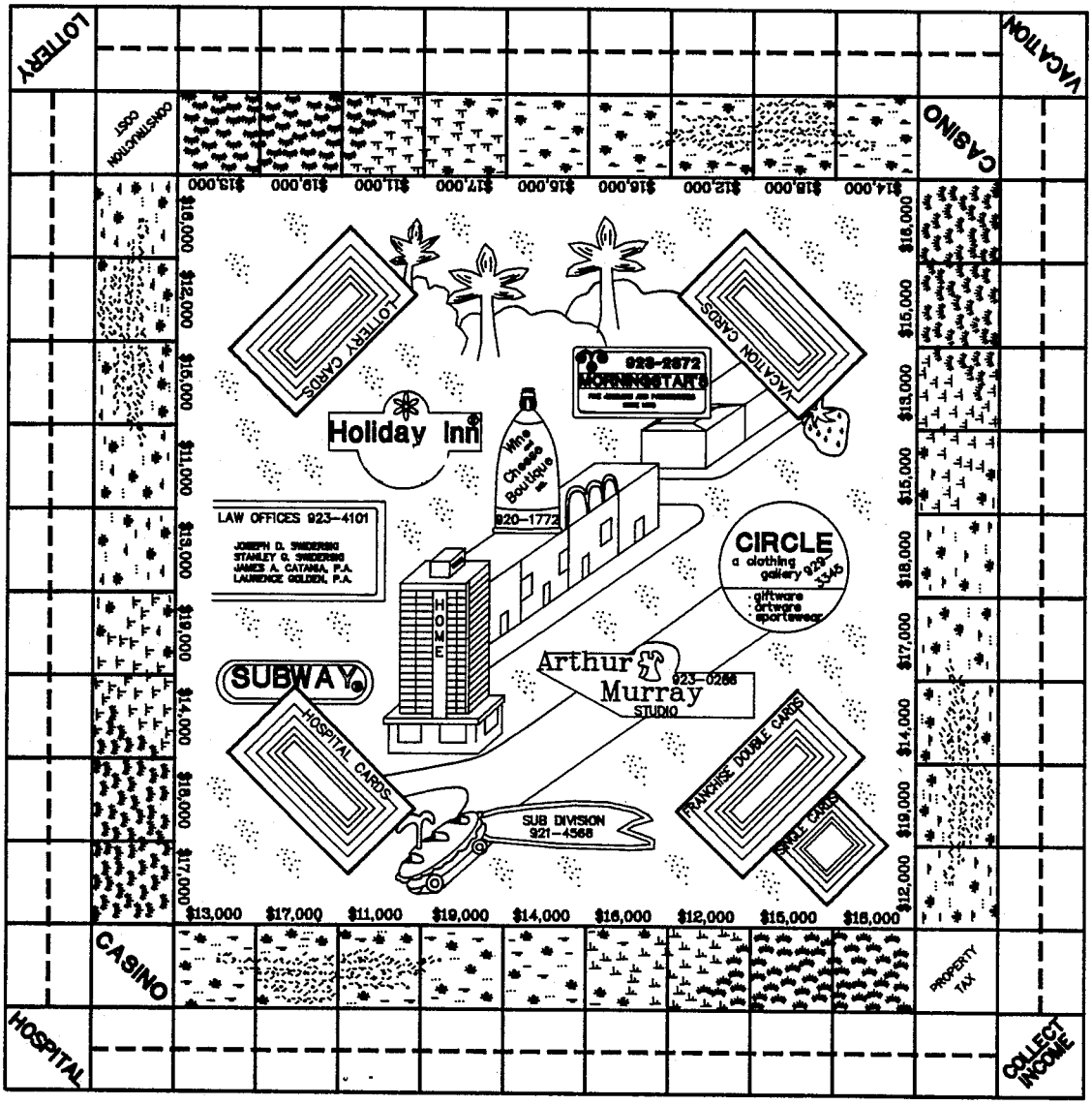
FIG. 2 illustrates the basic game board.
Figures 3, 3A, 4, 4A, 5, 5A, 6, 6A, 7, 7A, 8:
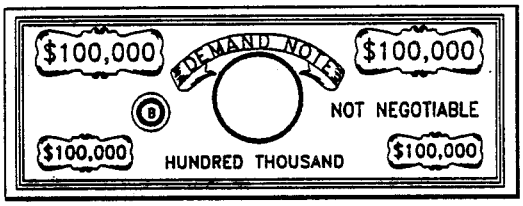
FIG. 3 illustrates a typical single space franchise or business property card.
FIG. 3A illustrates the reverse side of the card depicted in FIG. 3.
FIG. 4 illustrates a typical double space franchise or business property card.
FIG. 4A illustrates the reverse side of the card depicted in FIG. 4.
FIG. 5 illustrates a vacation card.
FIG. 5A illustrates the reverse side of the card depicted in FIG. 5.
FIG. 6 illustrates a typical chance card such as a lottery card.
FIG. 6A illustrates the reverse side of the card depicted in FIG. 6.
FIG. 7 illustrates a typical required services card such as a hospital card.
FIG. 7A illustrates the reverse side of the card depicted in FIG. 7.
FIG. 8 illustrates a typical game check used as currency for playing the game.

FIG. 1 illustrates the invention as the game evolves during play. It comprises a basic board 10, with five sets of cards; 3, 4, 5, 6 and 7; arranged at the corners of a central square 11. Arranged about the center square 11 is a border comprised of a plurality of rectangular spaces 12 forming a pathway about the center square bounded by the center square and the outer edges of the game board. Each rectangular area 12 emulate property with the exception of the spaces including the corner squares 13 through 20 which relate to special game functions. Each property space includes a value for which a player may purchase the property, assuming it has not previously been purchased by another player. The property spaces are dimensioned so that a business establishment card representing a franchise or other business establishment or property may be placed over the terrain simulating portion of the space 21 when a card is purchased. (For simplicity of this discussion the term franchise is used to represent franchises as well as all other forms of business). Typical cards are illustrated in FIGS. 3 and 4. These cards are paid for advertisements by real businesses such as franchises and serve to tie the game into contemporary life. For instance, the franchises available via the business property cards 3 and 4 may represent local franchises such as fast food establishments, grocery or department store or service organizations such as gas stations. The business property cards 3 and 4 and vacation cards 5 identify actual entities because the game is constructed by starting with a basic board as illustrated in FIG. 2 and developing sets of cards by selling card space as advertisements to real businesses. Ideally, the game cards are advertising for a variety of contemporary, local business establishments so that the game may be played by emulating all of the local businesses familiar to the players to enhance the fantasy which occurs during play.

In addition to the franchise cards illustrated in FIGS. 3 and 4, the game includes mandatory service cards such as the hospital cards illustrated in FIG. 7; lottery cards are illustrated in FIG. 5 which provide for easy cash if the person is lucky enough to land upon the proper square; and vacation cards as illustrated in FIG. 5.

Hospital cards, lottery cards and vacation cards are selected whenever a player lands on a designated square; 18, 19 and 13 respectively; on the game board.

The game is designed by selling the advertising advantage of being an integral part of the game to contemporary businesses such as franchises. This selling is for real value and not to be confused with the fantasy of play. Business or franchise cards or spaces are then designed to incorporate the business into the basic game board design and game rules. The game rules are modified to incorporate the businesses purchasing advertising into the game as an integral part of the play. In one embodiment, the game board and rules are fixed but the franchise card sets may be changed to reflect different geographical areas or types of business or new advertisers.

To play the game, players choose a car and matching realty signs. Different colored cars are used as place mark tokens 22 by each player and realty signs 23 are colored to match a players car. The realty signs are used to mark vacant lots owned by the player by placing them over the lot value as illustrated in FIG. 1. Players roll to see who will play first. Actual play then follows around the board. When a player lands on an empty lot, the player can purchase it for the value printed on the board, unless it has already been purchased by a previous player. When a player purchases a lot, he places one of his realty signs on the turf section 21 of the rectangle 12 to assert his ownership. During their travels around the game board, players may land on the follows spaces: hospital, lottery, and vacation spaces. Players must pick the matching cards for above mentioned spaces, and follow their directions. There are also spaces marked casino, where players can try their luck. Players may also be faced with landing on construction cost or property tax spaces and not be so lucky.

In the beginning of the game, the players purchase as many lots next to each other as possible. In one version of the game, the double space business or franchise cards must be purchased first. A player may purchase a single space business only when there are no double space cards available. During play, players may purchase or trade for lots to increase their economic advantage. After all of the vacant lots on any given street have been purchased, players can begin to buy businesses or franchises. There is no fee for players landing on opponents vacant lot but when a player lands on opponents business or franchise he must pay the amount printed on the card.

After players have developed an entire street by building franchises or business on all the property on the side of the board, the price charged a player for landing on the property increases to the higher printed amount on the card. The combination of buying, trading, and selling plays a major part in winning the game.

A preferred embodiment of the game includes the below listed equipment:

1. Playing board (FIG. 2)
2. Two dice
3. 8 Players tokens, each of a different color
4. 8 Sets of 20 colored real estate signs. Each set colored to match a game token
5. 12 Single franchise cards (FIGS. 3 and 3A)
6. 12 Double franchise cards (FIGS. 4 and 4A)
7. 20 Vacation cards (FIGS. 5 and 5A)
8. 20 Lottery cards (FIGS. 6 and 6A)
9. 20 Hospital cards (FIGS. 7 and 7A)
10. Play money and tray The preferred embodiment of the game is played according to the following rules:

Object of the Game: To purchase as many vacant lots as possible and build franchises on the lots. The player ending up with the greatest net worth becomes the winner.

Equipment: Playing board, two dice, player tokens, real estate signs, 12 franchises, 12 double franchises, lottery cards, hospital cards, vacation cards, and play money.

To start Game: Place gameboard face up on table, place face down on allotted spaces the following cards; Franchises, Double Franchises, Hospital, Vacation and Lottery. Each player chooses a different colored token and their matching color real estate signs. Players each receives $280,000 to start the game, (5-$1,000, 5-$5,000, 5-$10,000, 5-$20,000, 2-$50,000). One player can be banker also. All players place their tokens on Collect Income.

Banker: Players must choose a banker, the banker can also be a player. The Player/Banker must keep their money separate from the banks.

Bank: The bank collects all: Hospital, Property Tax, Vacation, Construction Cost, purchase of Vacant Lots, and Franchise money. The bank pays out all Lotteries, Casinos, Salaries and the ½ price for default of Vacant Lots or Franchises.

To Play: Players throw dice to see who goes first, the highest roller goes first. Play then follows to the left (Clockwise).). All tokens start on Collect Income, after each roll the players token remains on that space awaiting for their next turn. If a player rolls Doubles, the players continues with their turn after their first roll. There is NO Limit on the number of Doubles a player can throw in a row. More than one player can land on the same space. According to the space the players token lands on, the player may purchase the Vacant Lot, or gamble at the Casino, pay the Hospital, pick a Lottery card, pay the Construction Cost, pay for a Vacation, pay Property Tax, and later purchase Franchises after an entire street is purchased. Each time a player passes or lands on Collect Income, they collect $20,000.

Buying Vacant Lots: If a players token lands on a Vacant Lot, (A Vacant Lot is a lot that has no Real Estate sign or Franchise card on it). A player may buy a Vacant Lot for the printed value. If a player does not wish to buy the Lot, no other player can buy it. A player must land on a Vacant Lot in order to purchase it. Players should try to purchase Vacant Lots that are next to each other. Note: Players must buy the Double Franchises available for purchase. The trading of Lots will enable players to purchase the Double Lots.

Trading Vacant Lots: For the best means to becoming the Wealthiest player in the game. Players should trade ownership of Vacant Lots, in an effort to own two Lots which are next to each other. Players must wait till their turn before they make any trades.

Landing on Vacant Lots: There is no fee for players landing on Vacant Lots, mowed or unowned. Players may purchase if unowned or build Franchises on their Lots.

Buying Franchises: After an entire street of vacant lots has been purchased. Players owning two lots together have the option to purchase the Double Franchise cards. Players must pay the value printed on the back of the cards. After paying the bank for the Double Franchise cards, players place the cards on their vacant lots. Players needing two vacant lots together can buy or trade with other players to obtain the desired property. After all of the Double Franchises have been purchased, players can buy the Single Franchises. Players can only place Franchises on those streets that are totally purchased.

Paying Franchise Fees: Players landing on a space with a Franchise on it, must pay the lower price printed on the Franchise card. Only after the entire street has Franchises on it, owners then collect the higher price printed on the Franchise cards.

Collect Income: This space, 15, is used as the starting space of the game. Players also collect $20,000 every time they land on or pass this space.

Property Tax: This square, 16, has two sides, 24 and 25, to land on. When a players token lands on these spaces, a player must pay $1,000 for each Vacant Lot and $2,000 for each Franchise they own.

Hospital: When a player lands on this space, 18, they must pick a Hospital card. If there is an amount to pay the player must pay it to the bank. If a card reads lose a turn the player must follow the demands.

Casinos: These squares, 14 and 17, have two spaces each on either side of the board 26 and 27, and 28 and 29. When a players token lands on one of these spaces, the player calls out a number to the other players. Then rolls both dice, and if the same number comes up the player had called: (The player wins $100,000). If a player rolls Doubles, Win or Lose they get to roll again? There is no limit to the number of rolls a player can have. A player can win as much as their luck will allow. If a player rolled Doubles to land on this space, they will continue with their turn.

Construction Cost: This square, 20, has two sides to land on, 31 and 32. When a players token lands on these spaces, the player must roll both dice and pay $1,000 times the numbers shown on the dice.

Lottery: When a players token lands on this space, 19, the player picks a Lottery card. The player collects the amount from the bank.

Vacation: When a players token lands on this space, 13, the player must pick a Vacation card and follow the demands.

WAYS TO GET CASH

1. Selling Lots
2. Selling Franchises
3. Default on Lots
4. Default of Franchises Selling Lots: A player may sell Vacant Lots to any other player at any point during the game, as long as it is their turn to play. The price is whatever a player is willing to pay. Lots must be vacant to sell. A player that has purchased a Lot must then replace his Real Estate sign with the sellers.

Selling Franchises: A player may sell their Franchises to any other player at any point during the game, as long as it is their turn to play. The price is whatever a player is willing to pay. Franchises cannot be moved players that purchase them replace their Real Estate signs or sign with the sellers.

Default on Lots: Any player may Default on their Lots by removing their Real Estate sign, and collecting ½ of its purchase price from the bank. That lot becomes available for purchase, if a player lands on it. If a player Defaults on a Lot, players cannot purchase Franchises until that Lot is rebought. Note: Only on that street.

Default of Franchises: Any player can Default on their Franchises by removing the Franchise card from the Vacant Lot, and returning it face down on the bottom of the appropriate pile. Players then receive ½ of the printed value paid for the Franchise. Note: If it is a Double Franchise, players must purchase them first before they can continue to purchase the single Franchises.

Bankrupt: A player must declare Bankruptcy, when they owe more than the cash and the Default value of all their Vacant Lots and Franchises. A player must first Default their Franchises then their Vacant Lots. The player then combines their total cash, to pay either the bank or another player. Now it is time for that player to sit and watch or become the banker.

End of Game: The game ends when one player is left will all the wealth, and the others are all bankrupt. The game may be played in a variety of ways, such as:

1. Play until there is one player remaining, and all others are bankrupt.
2. Play until the first player is bankrupt, then call for a set time for the game to end. Then all players default their Franchises and Vacant Lots back into cash. The player with the most money wins the game.
3. Play until the second player goes bankrupt, and the game ends there. Then all players Default their Franchises and Vacant Lots back into cash. The player with the most money wins the game.
4. Play a time limit game of approximately one hour or more. With a rule change as follows: Players can purchase a Franchise as soon as they have a Vacant Lot to put it on. Players can buy Single or Double Franchises whichever they may choose. Turn all Franchises and Vacant Lots back into cash at the end of the time. The player with the most money wins.

An alternate embodiment of the game may be designed by incorporating the franchise or business cards directly as an integral part of the board design. In this embodiment, the double and single franchise cards 3 and 4 of FIG. 1 are not used and the advertisements 42 are printed directly on the board.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A board game including a playing surface comprises of spaces to which player's tokens are moved according to chance selection during play, comprising:

means for altering chance selected spaces during play of the game to dynamically alter said play, said means including a plurality of preselected cards:

said cards representing business entities for installation by players on one or more of said spaces previously acquired by the player during the course of the game, the acquisition of said spaces and said cards being achieved through a fantasy barter system by the players according to rules of the game; and said cards bearing indicia identifying contemporary businesses which have purchased the right to be included as part of the game as a means for advertisement, said purchases being the means for preselecting said cards through normal, nonfantasy business praetices of barter for real value such as money.

2. A board game as defined in claim 1, wherein said indicia is limited to franchised businesses.

3. A board game as defined in claim 1, comprising:

a plurality of instruction cards including play instructions requiring players to engage in special functions which involve the transfer of play money.

4. A board game as defined in claim 3, wherein selected ones of said spaces include game playing indicia requiring a player whose token stops at said space during the course of play to draw one of said instruction cards.

5. A board game as defined in claim 3, wherein said spaces are bifurcated to create a token moving lane from adjoining bifurcated portions of said spaces and building lots from the remaining portion of some of said bifurcated spaces.

6. A board game as defined in claim 3, wherein said instruction cards include sets of vacation cards, lottery cards and hospital cards.

7. A board game as defined in claim 6, wherein said vacation and hospital cards are cash penalty cards and said lottery cards are cash benefit cards.

8. A board game as defined in claim 1, wherein said cards comprise a set representing a specific area of interest.

9. A board game as defined in claim 8, further including a plurality of different sets of cards representing different areas of interest.

10. A board game including a playing surface comprised of spaces to which player's tokens are moved according to chance selection during play, comprising:

means for altering chance selected spaces during play of the game to dynamically alter said play, said means including a plurality of preselected cards;

indicia on selected ones of said cards representing business entities acquired by the players during the course of the game, acquisition of said spaces and said cards being achieved through a fantasy barter system by the players according to rules of the game; and said indicia identifies contemporary businesses which have purchased the right to be included as part of the game as a means for advertisement, said purchases being the means for preselecting said cards through normal, nonfantasy business practices involving the transfer of real money.

11. A board game as defined in claim 10, wherein said indicia is limited to franchised businesses.

12. A board game as defined in claim 10, comprising:

a plurality of instruction cards including play instructions requiring players to engage in special functions which involve the transfer of play money.

13. A board game as defined in claim 12, wherein said instruction cards include sets of vacation cards, lottery cards and hospital cards.

14. A board game as defined in claim 13, wherein said vacation and hospital cards are cash penalty cards and said lottery cards are cash benefit cards.

15. A board game as defined in claim 12, wherein selected ones of said spaces include game playing indicia requiring a player whose token stops at said space during the course of play to draw one of said instruction cards.

16. A method of playing a board game of the type including a playing surface comprised of spaces over which player's tokens are moved during play, including the steps of:

acquiring said spaces by purchasing them with play money according to the rules of the game;

purchasing with play money, cards representing real contemporary business entities including advertising indicia which was paid for with real money by the business, and installing said purchased cards on one or more of said spaces previously acquired during the course of the game.

17. A method of playing a board game as defined in claim 16, including the step of selecting from a plurality of sets of cards representing different areas of interest, one set for use in current play.

18. A method of playing a board game as defined in claim 16, wherein some of said spaces represent building lots, including the further steps of:

choosing a token and matching realty signs;

rolling dice to see who will play first;

moving a token around the board spaces according to a random number generator;

purchasing, with play money, unowned lots on which a token stops for the value printed on the board;

placing a realty sign on the board to assert ownership of the purchased lot;

purchasing, with play money, business or franchise cards bearing paid for advertising purchased with real money;

installing purchased business or franchise cards on acquired lots; and collecting fees indicated by said cards from players whose token stops on a lot improved by the installation of a business or franchise via the prior purchase of one of said cards.

19. A method of playing a board game of the type including a playing surface comprised of spaces over which player's tokens are moved during play, including the steps of:

acquiring dominion over said spaces by purchasing them according to the rules of the game and modifying said playing surface by at least partially covering selected acquired spaces with cards purchased according to the rules of the game, said cards including advertising indicia which was paid for with real money by businesses advertising thereon and which dynamically alter play of the game as a function of said indicia.

20. A method of playing a board game as defined in claim 19, wherein said indicia describe franchises.

21. A method of playing a board game as defined in claim 19, including the further steps of:

choosing a token and matching realty signs;

generating random numbers to see who will play first;

moving a token around the board spaces according to a random number generator;

purchasing spaces on which a token stops with play money for the value printed on the board;

purchasing identifying markers bearing indicia which alters the dynamics of the play of the game when placed on one or more of said spaces;

placing said purchased identifying markers on purchased spaces to assert ownership of the purchased space and a business advertised by indicia on said marker; and collecting fees as a function of said advertising indicia on identifying marker from players whose token stops on owned spaces having an advertising indicia thereon.

22. A method of designing a board game, including the steps of:

imprinting a playing surface with a pattern of bifurcated spaces to form a token movement lane;

imprinting a plurality of cards with indicia for altering the significance of individual ones of said spaces as a function of the indicia on the face of individual ones of said cards; and determining said indicia by selling, to contemporary businesses, the advertising advantage of being represented in the game by one of said symbols of improvement.

23. A method of designing a board game as set forth in claim 22, wherein said cards are said symbols of improvement for use in conjunction with said spaces.

24. A method of designing a board game as set forth in claim 22, including the further step of creating game playing rules which make said symbols of improvement integral elements in the play of the game.

25. A method of designing a board game, including the steps of:

imprinting a playing surface with a pattern of spaces to form a token movement path wherein some of said spaces are blank and some include an indication which is an integral element in the play of the game;

selling to contemporary businesses, the advertising advantage of being represented in the game as a business which is one of said integral elements of the play of the game; and imprinting a set of cards for covering said blank spaces during play of the game with indicia representing said contemporary businesses.

26. A method of designing a board game as set forth in claim 25, including the further step of creating game playing rules which make businesses purchasing said advertising advantage integral elements in the play of the game.

27. A board game including a playing surface comprised of spaces to which player's tokens are moved according to chance selection during play, comprising:

cards representing business entities for installation by players on one or more of said spaces previously acquired by chance selection by the player during the course of the game, the acquisition of said spaces and said cards being achieved through a fantasy barter system by the players according to rules of the game;

said cards bearing indicia which dynamically affects the play of the game and identifies contemporary businesses which have purchased the right to be included as part of the game as a means for advertisement, said purchases being achieved through normal, nonfantasy business practices of barter for real value such as money;

said cards including play instructions requiring players to engage in special functions which involve the transfer of play money; and said spaces are bifurcated to create a token moving lane from adjoining bifurcated portions of said spaces and building lots from the remaining portion of some of said bifurcated spaces.

* * * * *